United States Patent [19]

Manger

[11] 4,268,719

[45] May 19, 1981

[54] LOUDSPEAKER ARRANGEMENTS

[76] Inventor: Josef W. Manger, Karlstadter Strasse 30, 8725 Arnstein, Fed. Rep. of Germany

[21] Appl. No.: 75,899

[22] Filed: Sep. 17, 1979

Related U.S. Application Data

[63] Continuation of Ser. No. 911,063, May 31, 1978, abandoned.

[30] Foreign Application Priority Data

Jun. 4, 1977 [DE] Fed. Rep. of Germany ..... 2725346

[51] Int. Cl.[3] ..... H04R 1/20

[52] U.S. Cl. ..... 179/1 E; 181/144; 181/153

[58] Field of Search ..... 179/1 E, 115.5 PS, 116; 181/144, 145, 146, 147, 148, 151, 153, 199

[56] References Cited

U.S. PATENT DOCUMENTS

| | | | |
|---|---|---|---|
| 1,642,124 | 9/1927 | Miller et al. | 179/116 |
| 2,832,843 | 4/1958 | Messner | 179/180 |
| 3,393,764 | 7/1968 | Schafer | 179/1 E |

*Primary Examiner*—George G. Stellar

[57] ABSTRACT

The invention relates to a loudspeaker housing having a front wall and a back wall and at least two similar electroacoustic transducers. Objects of the invention are to create a loudspeaker having a limited or finite housing but which makes possible a sound reproduction with a quality similar to an electroacoustic transducer which is mounted in an infinite baffle, and to improve the known loudspeakers such that particularly the first wave fronts of the radiated sound pressure waves are properly reproduced. The loudspeaker of this invention is characterized in that one of the transducers is mounted in the front walls whereas the other transducer is mounted in the back wall of the housing, that both transducers are excited in phase and that the housing is a closed housing.

19 Claims, 17 Drawing Figures

LOUDSPEAKER ARRANGEMENTS

This is a continuation of application Ser. No. 911,063, filed May 31, 1978 now abandoned.

The present invention relates to loudspeaker arrangements.

Loudspeaker arrangements are used for converting electrical signals into audible sound and include at least one electro-acoustic transducer which generally has a diaphragm which is reciprocateable in a piston-like manner, and is arranged in a closed housing or a housing with at least one opening. Hitherto the most important parameter in the loudspeaker art has been the frequency. All hifi standards are directed to preserving given values which are dependent on the frequency. In doing this, the fact that analyses or standards which only take account of the mean positive amplitude squares of the acoustic pressure in dependency on frequency, such squares being determined over a relatively long period of time, cannot detect those important acoustic pressure changes of a duration of some microseconds or milliseconds, which the human ear must continuously process and whose peak values correspond to the difference in the peak values of the positive and negative amplitudes of the acoustic pressure, was overlooked. Therefore, the view is increasingly frequently taken not only with regard to the reproduction of music but for example also with regard to damage to hearing caused by excessive noise in the place of work, that the dependency of the acoustic pressure on time is of greater significance than the dependency of the acoustic pressure on frequency and the presevation of given frequency characteristics (HiFi-Stereofonie, issue 3/1977, page 369, 'Music hearing test' and commentary; Technical Review, No 1, 1976, pages 4 to 26, published by Bruel & Kjaer). This view is supported by the fact that the so-called first wave front, that is to say, the first half wave of a rectangular or sinusoidal acoustic pressure wave which is radiated by a sound source appears to be particularly important for example for the location and musical tone of a sound source, because pressure changes within the first wave front, which are caused by system-inherent interference, have an unpleasant effect on the location and tone; system-inherent interference is taken to mean the interference or defects in the transmission path in the conversion of electrical oscillations into sound waves, which are not present in the electrical signal to be reproduced.

The invention therefore starts from the recognition that investigations or regulations which depend on the measurement of a mean acoustic pressure of the frequency spectrum of a sound source cannot give satisfactory results, unless they are accompanied by investigations or regulations relating to the characteristic in time of the first wave fronts.

It will be appreciated that measurements taken on loudspeaker arrangements with different kinds of housings show that the first wave fronts are only transmitted well by those loudspeaker arrangements whose electro-acoustic transducers are installed in an infinite acoustic baffle and which are therefore not suitable for practical purposes. In contrast, housings with finite dimensions result in considerable falsification of the first wave fronts, so that these cannot be cleanly reproduced by conventional loudspeaker arrangements.

The invention therefore starts from the further recognition that, in all previously known loudspeaker arrangements, the housings in particular are the cause of numerous interference phenomena in the region of the first wave fronts.

According to the invention, derived for the first time from the above-mentioned recognitions and phenomena is the problem of providing a loudspeaker arrangement which reproduces the first wave fronts with a similar degree of quality to a transducer arranged in an infinite acoustic baffle, but which has a housing of finite dimensions. In this respect the housing is in particular to be so constructed that, upon single rapid and abrupt excitation in one or other direction, the loudspeaker arrangement produces, at a measuring position in front of the housing, an acoustic pressure which, after reaching a maximum value (minimum value) falls, (rises) almost linearly to a minimum value (maximum value) and exhibits a reversal of direction in its development in time, only at the latest possible moment of time, for example after more than about 4 milliseconds, before tending to resume its normal value.

To solve this problem, in accordance with the invention, there is provided a loudspeaker arrangement comprising a closed housing having a front wall and a rear wall, and at least two similar electro-acoustic transducers, wherein one of the said two transducers is arranged in the front wall and the other of the said two transducers is arranged in the rear wall and the said two transducers are so connected that when electrically coupled to a common source the respective diaphragms of the said two transducers are moved simultaneously outwardly or inwardly.

It is already known for a plurality of transducers, for example a plurality of high-pitch, medium-pitch and low-pitch transducers, to be diposed in a housing. However, in contrast to the loudspeaker according to the invention, such loudspeaker arrangements do not provide for clean reproduction of the first wave fronts. This also applies as regards other known loudspeaker arrangements (U.S. Pat. No. 3,393,764) which have a housing with a respective transducer arranged in each of the front and rear walls. The essential difference of this known loudspeaker arrangement from the loudspeaker arrangement according to the invention is in fact that the housing of the known loudspeaker arrangement is not completely closed but has an opening which, during operation of the loudspeaker arrangement, permits constant equalisation of pressure between the front and rear sides of the diaphragms of each transducer and discharges air under pressure outwardly upon each inwardly directed stroke movement of the diaphragms, while drawing air from the outside into the housing on each outwardly directed stroke movement of the diaphragms. Consequently, such an opening in the housing can at low frequencies result in what are known as acoustic short-circuits. Moreover, each opening in a housing acts as an additional emission source which operates in phase opposition relative to the diaphragms and radiates pressure waves which can detrimentally interfere in many ways with the pressure waves which are radiated by the two diaphragms. Such openings in the housing therefore oppose the simulation of an infinite acoustic baffle and result in considerable falsification of the first wave fronts. To overcome this disadvantage, according to the invention there is provided a closed housing, the term 'closed' meaning that, with the exception of some leaks which permit the normal pressure in the housing to be adjusted to the pressure of the outside atmosphere, the housing does not have openings of any kind.

The invention provides the substantial advantage that the second transducer which is installed in the rear 1 of the housing has an action very similar to that of an infinite acoustic baffle. Measurements on the loudspeaker according to the invention show that, when the two diaphragms are abruptly excited, the loudspeaker arrangement produces pressure curves such as hitherto could only be produced with transducers installed in an infinite acoustic baffle.

The invention will now be explained and described in more detail, solely by way of example, with reference to the accompanying drawings, in which.

Figure 1:
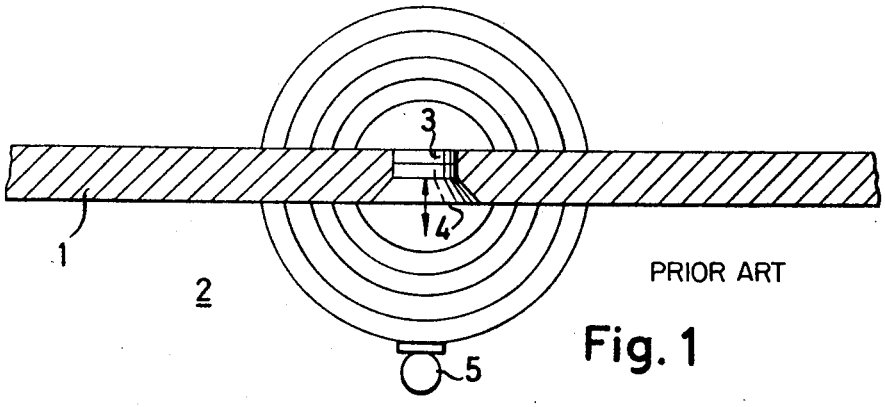
FIG. 1 shows an eletro-acoustic transducer installed in an infinite acoustic baffle partition.

FIG. 1 shows a known arrangement for measuring the variation in time of the acoustic pressure at a position in front of a transducer, without interference by echoes. Secured in a wall 1 of a room 2 is an electro-acoustic transducer 3 having a diaphragm 4, which can be reciprocated piston-like in the direction indicated by the arrow by a moving coil and whose front face terminates substantially flush with the wall 1 in the non-excited condition (U.S. Pat. No. 3,201,529). Set up in front of the transducer 3 is a microphone 5 which is used for receiving the sound waves radiated by the transducer 3 or for measuring the acoustic pressure produced by the transducer 3 at the location of the microphone 5. The microphone 5 which can measure acoustic pressures down to 10 Hertz, is a half-inch free-field capacitor microphone, like the microphone shown in FIGS. 4, 6, 8 and 11, and is connected to an electron beam oscillograph (not shown) which is used for visual representation of the acoustic pressure at the location of the microphone 5 as a function of time.

The wall 1 acts as an infinite acoustic baffle partition which prevents acoustic short-circuits, that is to say, which prevents propagation of the acoustic pressure waves into the space which is behind the wall 1, with respect to the room 2. The acoustic pressure waves therefore propagate in a hemispherical pattern at the speed of sound over a spatial angle $2\pi$. In arranging the microphone 5 and the transducer 3, care should be taken to ensure that their distances from any reflecting surfaces are sufficiently large for echo waves to reach the microphone 5 only after transit times which are at least about 5 milliseconds greater than the transit times which correspond to the direct distance of the transducer 4 from the microphone 5, which corresponds to a distance of about 3.7 meters, when the direct distance is 2 meters.

Figure 2:
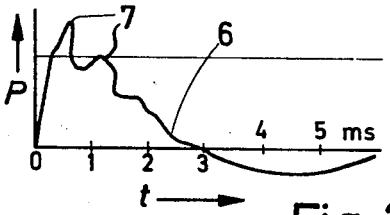
FIG. 2 shows the acoustic pressure curve as a function of time, recorded with a conventional transducer in the arrangement shown in FIG. 1.

If the diaphragm 4 is abruptly pushed forward towards the room 2 and left in that position, a variation in the amplitude of the acoustic pressure P as a function of time t, corresponding to the curve 6 in FIG. 2, occurs at the location of the microphone 5. The amplitude first rises rapidly, reaches a maximum value then gradually decreases, passes through the O-line corresponding to the normal pressure, reaches a minimum value, and then gradually tends back to the normal value.

The pressure peaks 7 which are settled in the positive region and which indicate the acoustic pressure change in the positive and negative direction are worth noting on the curve 6. Such pressure changes which are caused in particular by oscillations of the diaphragm when the diaphragm is suddenly energised and by other spring-/mass effects which cannot be avoided in conventional transducers, and the substantially e-shaped fall in the curve 6 result in considerable falsification of the acoustic pressure at the location of the receiver and thus falsification of the information perceived by the receiver, as they are not contained in the radiated information which corresponds to the sudden energisation.

Figure 3:
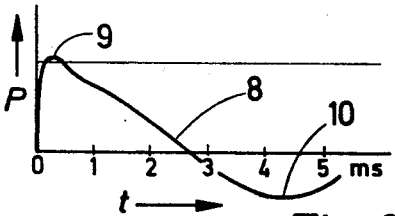
FIG. 3 shows the acoustic pressure curve as a function of time, as recorded with a transducer of novel kind in the arrangement shown in FIG. 1.

The curve 8 shown in FIG. 3 shows a virtually ideal form. It was obtained in an arrangement as shown in FIG. 1, with a transducer as disclosed in DE Patent specifications Nos. 1,815,694 and 2,236,374 or DE Offenlegungsschrift No. 2,500,397, which does not cause any substantial spring/mass effects and which does not cause any interference pressure changes, even when suddenly energised, by virtue of the use of visco-elastic diaphragm. In addition, after reaching its maximum value or its first direction-reversal point 9, the curve 8 falls virtually linearly to the minimum value or second reversal point 10, which occurs at about 4.5 milliseconds.

The frequency which can be calculated from the distance in time between the two reversal points 9 and 10 can be denoted as the system-inherent resonance frequency of the whole loudspeaker arrangement comprising the transducer 3 and the wall 1. Because the curve 8 does not have any interference ripples between the reversal points 9 and 10 and extends substantially linearly instead of in accordance with an e-function, rectangular signals down to at least about 110 Hertz and sinusoidal signals down to at least about 55 Hertz should still be properly transmitted with the system used for recording the curve 8, as, when the diaphragm is excited with a rectangular signal, its first half-oscillation must be associated with the region between the reversal points 9 and 10, while when the diaphragm is excited with a sinusoidal signal, its first quarter serves to deflect the diaphragm to its maximum value and therefore the second quarter of the sinusoidal oscillation can be associated with the region between the reversal points 9 and 10. The previous measurements confirm this.

Figure 4:
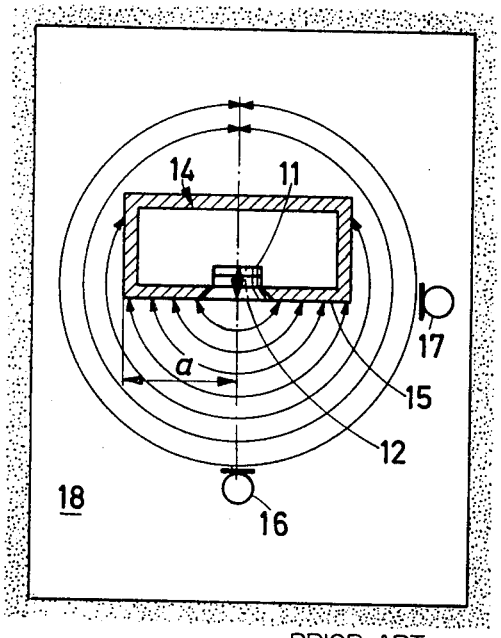
PRIOR ART Fig. 4
FIG. 4 shows a loudspeaker arrangement set up in a room, and comprising an electro-acoustic transducer arranged in a housing.

The arrangement shown in FIG. 4 which is used for measuring the variation in time of the pressure waves radiated by a loudspeaker arrangements with a finite closed housing includes an electro-acoustic transducer 11 with a diaphragm 12 which is reciprocable in the direction indicated by the arrow. The transducer 11 is mounted in the front wall 15 of a loudspeaker housing 14 in such a way that, in the non-excited condition, the front face of the diaphragm 12 terminates substantially flush with the front wall 15. Two microphones 16 and 17 are provided for measuring the variation in time of the acoustic pressure, the microphone 16 being arranged substantially on the central axis of the diagraphm 16 and the microphone 17 being arranged in a plane formed by the front end of the wall 15, at the level of the diaphragm 12. The housing 14 or the diagraphm 12 and the microphones 16 and 17 are also arranged in a closed room 18 in such a way that the pressure waves produced by the diaphragm 12 reach the microphones 16 and 17 by direct transmission, about six to ten milliseconds earlier than any reflected pressure wave.

Figure 5:
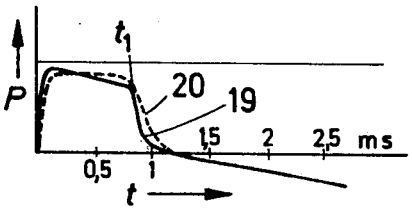
FIG. 5 shows the acoustic pressure curve as a function of time, as recorded with the arrangement of FIG. 4.

When the diaphragm 12 is abruptly excited, the curves 19 and 20 shown in FIG. 5 are produced, the curve 19 being recorded with the microphone 16 and the curve 20 being recorded with the microphone 17. Both curves 19 and 20 have an abrupt drop in the acoustic pressure, which is not found in the curves 6 and 8 shown in FIGS. 2 and 3, at a point $t_1$. This drop in the acoustic pressure is to be attributed to the finite nature of the housing 14 and causes a characteristic pressure change within the first wave front, such pressure change being responsible for mis-information. When using the transducer used to record the curve 8, the drop at point $t_1$ is particularly clearly accentuated, as the curves 19 and 20 are of virtually linear nature, up to the moment $t_1$.

The cause of the fall in pressure at the point $t_1$ may be calculated from the speed of sound. The sudden excitation of the diaphragm 12 causes a pressure change in the room 18, which at first is only propagated into the space directly in front of the diaphragm 12, because of the use of a closed housing, as in the case of the infinite acoustic baffle shown in FIG. 1. After about a period $t=a/c$, where a is the distance of the diaphragm centre point from the end of the wall 15 and c is the speed of sound, the pressure changes caused by the diaphragm 12 can also be propagated into the space which is behind the wall 15, that is to say, on the side of the wall 15 remote from the microphone 16. In other words, after the time $t=a/c$ the pressure changes can be propagated in a spatial angle $4\pi$, instead of $2\pi$. The result of this effect is that the acoustic pressure at the location of the microphone 16 suddenly drops abruptly after a time of about $t=a/c$ from the beginning of the measurement operation. Measurements have shown that the time $t_1$ of the fall in pressure substantially corresponds in fact to the value a/c. Corresponding deliberations confirm that the drop in acoustic pressure (curve 20) which is measured with the microphone 17 must also be attributed to the finite nature of the housing 14.

When using a finite housing, the first wave front can therefore be cleanly reproduced only when the time interval $t=a/c$ is greater than about 5 milliseconds. For this purpose the distance a should be about 1.7 meters, which is unrealistic for practical applications. In all conventional housings, the distance a is only about 10 to 40 centimeters, corresponding the values $t=a/c$ of 0.294 and 1.17 milliseconds or frequencies of 1700 and 425 Hertz. Below these frequencies the first wave fronts can no longer be cleanly reproduced with conventional housings.

According to the invention, it was surprisingly found that the fall in the acoustic pressure, caused by the housing, may be considerably reduced if a second electro-acoustic transducer is built into the rear wall of the housing, the radiation performance of said second electro-acoustic transducer substantially corresponding to that of the transducer incorporated in the front wall of the housing, at least at the frequencies which suffer interference from the housing, and the second electro-acoustic transducer being energized electrically 'in phase' in relation to the first transducer, in such a way that the diaphragms of both transducers always more simultaneously outwardly or simultaneously inwardly. An arrangement of this kind is diagrammatically shown in FIG. 6.

A closed rectangular housing 23 is arranged in a room 22, a transducer 25 having a diaphragm 26 being disposed in the front wall 24 of the housing 23. A similar transducer 28 having a diaphragm 29 is mounted in the rear wall 27 of the housing 23, which is parallel to the front wall 24. The two transducers 25 and 28 are so arranged that, in the non-energised condition, their diaphragms terminate substantially flush with the front or rear face respectively of the front or rear wall 24 or 27 respectively. As in the preceding examples, the two diaphragms can be reciprocated in the manner of a piston or a dish, and the two transducers 25 and 28 are electrically connected in such a way that, when they are abruptly excited, the diaphragms are simultaneously pushed forward outwardly in the direction of the arrows $P_1$ and $P_2$. The acoustic pressure is measured with a mircophone 30, in front of the transducer 25. The two transducers 25 and 28 or their diaphragms 26 and 29 are also arranged coaxially.

Figure 7:
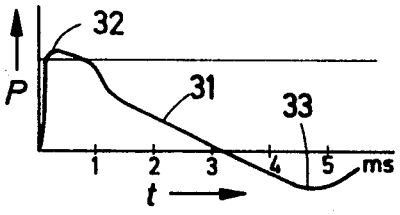
FIG. 7 shows the acoustic pressure curve as a function of time, as recorded with the arrangement of FIG. 6.
Figure 6:
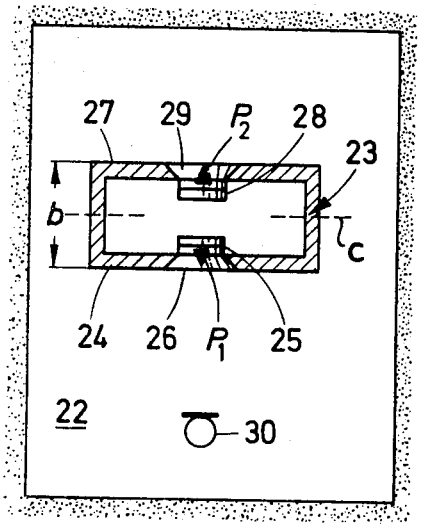
FIG. 6 shows a loudspeaker arrangement according to the invention, set up in a room and comprising two transducers arranged in a housing and connected in parallel in phase.

The curve 31 produced with the arrangement shown in FIG. 6 is illustrated in FIG. 7 and shows that the pressure drop at the point $t_1$, which was charactertistic for the curve 19 shown in FIG. 5, has virtually disappeared, and that the curve 31 has a somewhat wider curve portion between the two direction-reversal points 32 and 33, corresponding to a time of about 5 milliseconds, in comparison with the curve 8 shown in FIG. 3.

Figure 8:
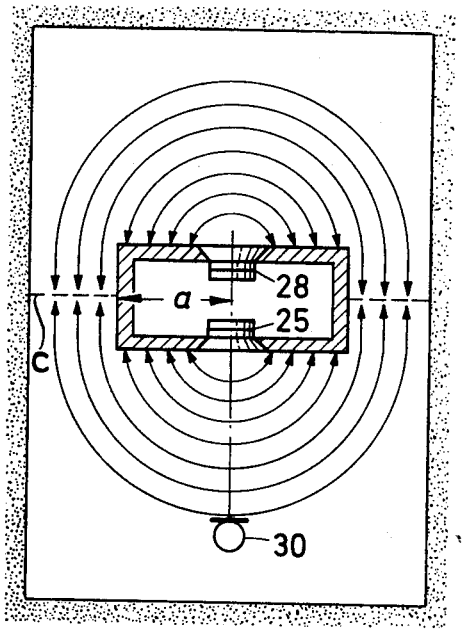
FIG. 8 shows a possible explanation for the improvements achieved with the arrangement shown in FIG. 6.

The transducer 28 disposed in the rear wall 27 has the same effect as an infinite acoustic baffle partition which could therefore be imagined in the plane of symmetry between the two transducers 25 and 28. The pressure wave field produced by the transducer 28 could therefore be termed a 'pneumatic acoustic baffle partition' of virtually infinite size. FIG. 8 diagrammatically indicates that the pressure changes produced by the diaphragm 26, indeed, as in the case of FIG. 4, after covering the distance a, have a tendency to be propagated in the spatial angle $4\pi$, that is to say, also into the space behind the front wall 24. However, in contrast to FIG. 4, this is prevented by the diaphragm 29 producing corresponding pressure changes. The pressure wave fields produced by the two diaphragms 26 and 29 meet in the plane of symmetry of the loudspeaker arrangement and are influenced along this plane of symmetry precisely as if an infinite baffle partition were arranged in the plane of symmetry.

Figure 9:
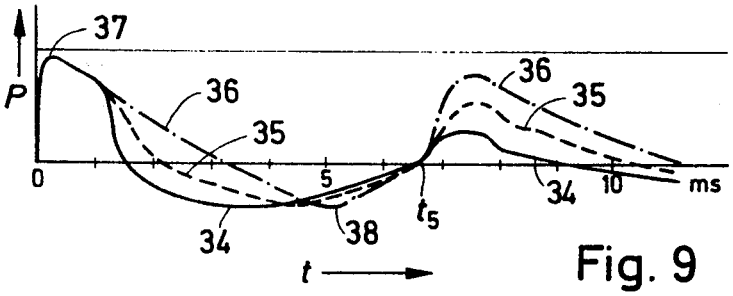
FIG. 9 shows a comparison of the acoustic pressure curves as a function of time, as recorded with the arrangements shown in FIG. 6.

Further confirmation that the second transducer 28 acts like a pneumatic acoustic baffle partition is supplied by the curves 34, 35 and 36 shown in FIG. 9. The curve 34 was recorded with an arrangement as shown in FIG. 6, wherein the transducers 25 and 28 were 'in phase opposition', that is to say, they were so poled that in the event of abrupt excitation, the diaphragm 26 of the transducer 25 was deflected in the direction of the arrow $P_1$ and at the same time the diaphragm 29 of the transducer 28 was deflected in the same direction, that is to say, in a direction opposite to the direction indicated by the arrow $P_2$. Only the transducer 25 was used to record the curve 35, with the transducer 28 short-circuited so that the diaphragm of the transducer 28 is driven by sound pressure and its moving coil has currents magnetically induced therein which are resistively dissipated. The curve 36 was recorded with in phase excitation of the two transducers 25 and 28. In addition, in contrast in FIGS. 5 and 7, the first echoes were recorded, such echoes being produced substantially by reflection of the sound waves at the ground. The time scale is approximately twice that of FIGS. 3, 5 and 7.

After a time $t_5$, the curve 35 has a first echo of medium magnitude, which corresponds to about 45% of the maximum amplitude of the first wave front, whereas the first echo of the curve 35 is considerably greater and corresponds to a value of 95% of the maximum amplitude of the first wave front. It follows from these measurements that, for locations in the room in which the microphone 30 is disposed, the second transducer 28 has the same effect as an infinite acoustic baffle partition, as echoes of similar magnitude can only be measured with an arrangement shown in FIG. 1.

The curve 31 (FIG. 7) does not extend in a completely linear fashion between the reversal points 32 and 33 as the housing 23 shown in FIG. 6 is rectangular and the distance b (FIG. 6) causes interference. Similar interference occurs when using a spherical housing with a diameter of for example 50 centimeters.

Figure 10:
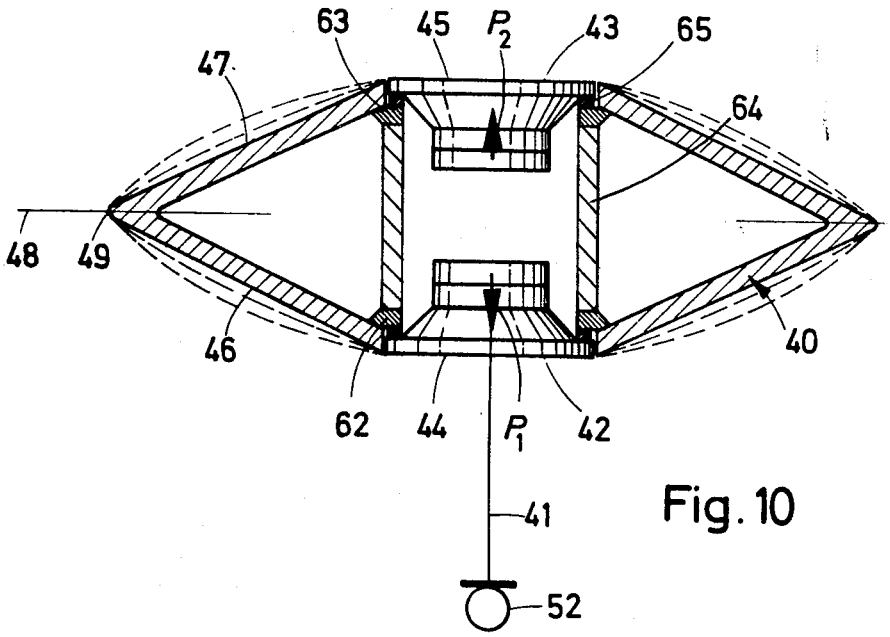

The interference which can be seen from the curve 31 may be substantially avoided by using a housing as shown in FIG. 10. The loudspeaker arrangement shown in FIG. 10 includes a discus-shaped rotationally symmetrical housing 40 which is of rhomboid configuration in cross-section. As will be seen from FIG. 10, two coaxial electro-acoustic transducer 42 and 43 are mounted on the axis of rotation 41 in such a way that their diaphragms 44 and 45, is the non-excited condition, represent the most uniform possible continuation of the outside of the housing walls. In this case the axis 41 is at the same time the central axis of the two diaphragms 44 and 45. The two transducers 42 and 43 are so connected, as in the loudspeaker of FIG. 6, that the two transducers are energised electrically in phase. Starting from the fixing edges of the transducers 42 and 43, the distance of the front wall 46 from the rear wall 47 of the housing 40 becomes smaller and smaller until the walls 46 and 47 meet in the plane of symmetry 48 which extends normal to the axis 41. The walls 46 and 47 thus extend towards each other until they meet at the outside periphery 49 of the housing 40, and form two half-shells which comprise the housing 40.

Between the fixing points of the transducers 42 and 43 and the outside periphery 49 of the housing 40, the walls 46 and 47 preferably are not flat, but have a slightly convex curvature. The degree of curvature is best determined with reference to the acoustic pressure curves measured with the loudspeaker arrangement of FIG. 10. Apart from this, slight curves in the walls 46 and 47 provide the advantage that the walls are less sensitive to bending vibration phenomena. The walls 46 and 47 are preferably in the form of spherical surface, as indicated by the broken lines in FIG. 10. The radius of the spherical surfaces should be greater than the measurement a (FIG. 11), in order to avoid the imperfections which occur in the case of spherical housings.

Figure 11:
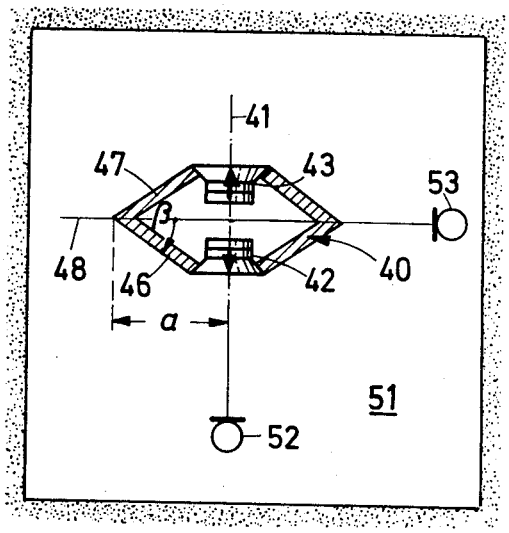
FIGS. 10 and 11 show further embodiments of the housing of the loudspeaker arrangement according to the invention.
Figure 12:
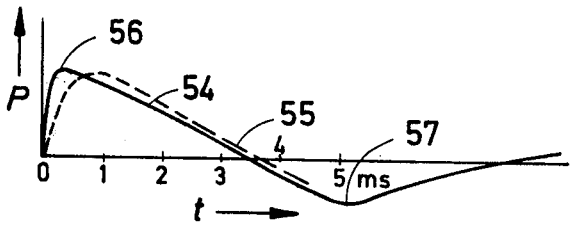
FIG. 12 shows the acoustic pressure curves as a function of time, as recorded with the arrangement of FIG. 10.

FIG. 11 shows the arrangement shown in FIG. 10 in a room 51, wherein two microphones 52 and 53 are used for measuring the acoustic pressure. The microphones 52 and 53 are arranged on the axis of rotation 41 and in the plane of symmetry 48, respectively, at the same height as the center points of the diaphragms. When the diaphragms 44 and 45 are abruptly excited in the direction indicated by the arrows $P_1$ and $P_2$, the curves 54 (microphone 52) and 55 (microphone 53) shown in FIG. 12 are produced when transducers 42 and 43 as disclosed. in DE Patent specifications Nos. 1,815,694 and 2,236,374 or in DE Offenlegungsschrift No. 2,500,397 are used, whose diameters are 19 centimeters, with the diameter of the outside periphery 49 of the housing 40 being 70 centimeters. The two transducers 42 and 43 are moreover substantially identical.

Between the reversal points 56 and 57 the curves 54 and 55 extend substantially linearly. The distance in time between the reversal points 56 and 57 is about 5 milliseconds. The rise time between the zero point of excitation and the first reversal point 56 on curve 54 is about 18 milliseconds.

Figure 13:
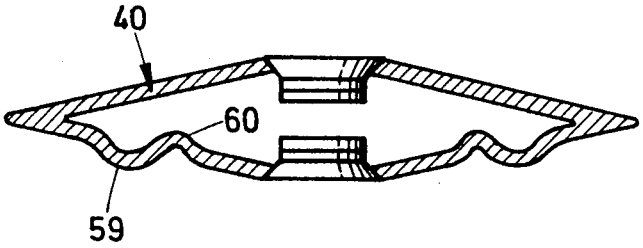
FIG. 13 shows a further embodiment of the housing of the loudspeaker arrangement according to the invention.

Occassionally, slight deviations from linearity are found in the measured acoustic pressure curves shown in FIG. 12, which deviations can be caused by the clamping of the transducers in the housing or by discontinuities in the transition from the housing wall to the diaphragm surface, and interference phenomena produced thereby. Such interference may be compensated by corrugations in the housing wall, in particular the front wall 46, each convex corrugation in the wall causing the curves 54 and 55 to be lifted and each concave curvature in the wall causing the curves 54 and 55 to be lowered. FIG. 13 shows a housing which corresponds to the housing shown in FIG. 10 and which has a convex annular bulge 59 and a concave annular bulge 60 in the front wall 46. The limits of such correction means are determined by the inside radius of 9.5 centimeters of the housing 40 and the outside radius of 35 centimeters of the housing 40 shown in FIG. 13, which corresponds to frequencies of about 1790 and 486 Hertz, or transmission times of 0.28 and 1.02 milliseconds.

FIG. 12 also shows that very similar curves are obtained with the microphones 52 and 53 (FIG. 11), although the rise time of the curve 54 is substantially shorter. The loudspeaker shown in FIG. 10 is therefore virtually an emitter of zero order, when the diaphragms are abruptly excited.

The dimensions of the transducers of FIGS. 6 and 10 depend in particular on the desired position of the second reversal points 33 and 57 respectively.

The smaller the housing, the shorter is the distance between the two reversal points 32 and 33 or 56 and 57 respectively. In addition, the speed of the fall in acoustic pressure in FIG. 12 increases in proportion to the increase in the angle $\beta$ shown in FIG. 11; this agrees with the observation of the steep fall in respect of a spherical housing. The smaller the angle $\beta$, that is to say, the closer the outside of the diaphragms 44 and 45 respectively are moved towards the plane of symmetry 48, the better is the form of the curves 54 and 55.

Particular advantage of the above-described loudspeaker is that all housing constructions according to the invention involve no deterioration but possibly an improvement in the usual frequency characteristic of the entire loudspeaker.

Figure 14:
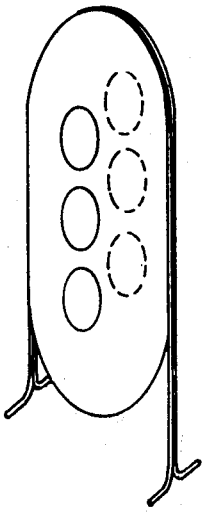
FIG. 14 shows a further embodiment of a loudspeaker arrangement according to the invention.

The invention is not limited to the embodiments described. Thus, it is possible for example for the two transducers which are incorporated in the front and rear walls of the housing to be arranged somewhat asymmetrically and not precisely coaxially, although the best results are achieved with a completely symmetrical arrangement as shown in FIG. 10. In addition, two or more transducers may be arranged in each of the front and rear walls of the housing, as indicated in the plan view of FIG. 14, in which case an excellent directional effect or directional characteristic may be achieved by arranging a respective group of a plurality of transducers along a respective straight line, in particular on a line normal to the axis of rotation 41 and normal to the plane of the drawing in FIG. 10. In this connection, it is also possible to use housings which are not rotationally symmetrical but which have cylindrical front and rear walls. In addition, care should be taken to ensure that the transitions between the diaphragms and the housing walls are clean and smooth, without abrupt transitions, the effects of which can be seen from the curves shown in FIG. 12. Any means conventional in the loudspeaker art can be used for this purpose.

In addition, the transducer 43 (FIG. 10) installed in the rear wall 47 could differ from the transducer 42 installed in the front wall 46 and in particular could be cheaper and of poorer quality, insofar as only frequencies which are greater than the housing dimensions are to be transmitted, as the rear transducer becomes less and less important at higher frequencies; this can be deduced from the fact that the falls in pressure in the curves 19 shown in FIG. 5, which were recorded with a microphone 16 as shown in FIG. 4, only ever appear after periods of time which approximately correspond to the transmission time of the sound waves from the centre point of the diaphragm to the end of the housing. It will be appreciated that, for the purposes of improving the curves 20 shown in FIG. 5, which are recorded with the microphone 17 of FIG. 4, transducers of substantially equal quality should be installed in the front and rear walls, as both transducers contribute substantially to the acoustic pressure at the location of the microphone 17, even at medium frequencies.

The loudspeaker according to the invention make it possible to achieve spatial and temporal resolution effects which were not previously known, in conjuction with optimum spatial localisation not of the loudspeaker arrangement itself but of the sound sources which are to be represented by the sound waves to be transmitted. When using acoustic transducers as disclosed in DE Patent specifications Nos. 1,815,694 and 2,236,374 and DE Offenlegungsschrift No. 2,500,397, there is the further advantage that these transducers do not cause any interference pressure changes in the region of the first sound wave fronts, which is important for radiation which is true to the original, so that a single system-inherent resonance frequency of about 50 Hertz is obtained with such transducers in the loadspeaker arrangements according to the invention, for the entire system comprising transducers, diaphragms, and housing. The loudspeaker arrangements according to the invention therefore provide in particular for the reproduction of music, matchless beauty and purity. Added to this is the fact that the intensity of radiation of the loudspeaker arrangement according to the invention undergoes only very little change, in comparison with loudspeaker arrangements shown in FIG. 4, irrespective of whether the loudspeaker arrangement is positioned in the open or in a room and close to a wall or close to the floor. The loudspeaker arrangement according to the invention is independent of its environment, by virtue of the pneumatic or acoustic baffle partition and the resulting precise radiation of the first wave front.

The invention is also not restricted to the system-inherent resonance frequency being about 50 Hertz, as lower and higher resonance frequencies may be achieved by altering in particular the diaphragm surface area.

Another important advantage of the loudspeaker arrangement according to the invention can be achieved by the two transducers or the front and rear wall of the housing being supported relative to each other. FIG. 10 shows that the transducers 42 and 43 are each supported in a respective ring 62 and 63 and the two rings 62 and 63 are fixedly connected together by a strut arrangement 64. As a result of this construction, any reaction forces which are produced by the in-phase parallel oscillations of the moving coils and diaphragms in the directions indicated by the arrows $P_1$ and $P_2$ are carried by the strut arrangement 64 and are not transmitted to the loudspeaker housing 40. It is particularly advantageous for the transducers additionally to be mounted in the rings 62 and 63 so as to be isolated and damped by means of visco-elastic rubber rings 65 or the like, to prevent vibration from being transmitted to the housing. Alternatively, the transducers may be mounted in the housing walls in a damped and isolated manner, while the strut arrangement is mounted at another position, for example in the region of the annular bulged portions 59 and 60 (FIG. 13), in order to avoid flexing of the housing walls at these positions. In contrast to conventional loudspeaker boxes, the housings of the loudspeaker arrangements according to the invention, may therefore be made from substantially thinner materials, for example materials which are from 3 to 4 millimeters in thickness, without this resulting in interference resonances or without the fear of the housing flexing. Finally, the same measures may be taken in the interior of the housings of the loudspeaker arrangements according to the invention for the purposes of avoiding interference resonances (for example filling the housing with sound-absorbent materials), as is known and usual in conventional loudspeaker arrangements. The same applies for all other measures outside the basic concept of the invention.

Figure 16:
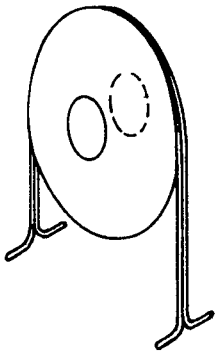
FIGS. 15 and 16 show embodiments for mounting or standing the loudspeaker arrangement according to the invention in the room.
Figure 15:
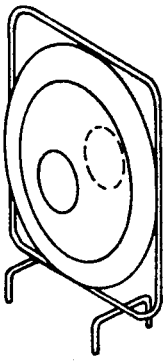

The loudspeaker arrangements according to the invention may be hung up or set up in the room, for the purposes of mounting. The examples of this are shown in FIGS. 15 and 16. The dimensions of the frames required for mounting the loudspeaker arrangements do not have any substantial influence on the nature of the first wave fronts, as their dimensions are small in comparison with those wavelengths at which the loudspeaker arrangements according to the invention enjoy particular advantages.

Figure 17:
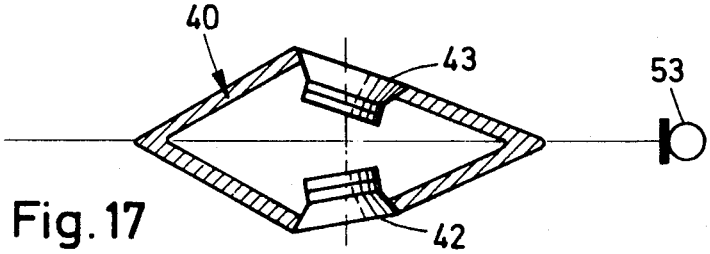
FIG. 17 shows a further embodiment of a loudspeaker arrangement according to the invention.

The field of use of loudspeaker arrangements according to the invention is also not limited to the examples described. A particular field of use is afforded for example by dummy head stereophony in which one earphone is normally used for each ear, as stereophonic transmissions are not possible with only one conventional loudspeaker arrangement. In contrast, dummy head stereophony may be embodied with a single loudspeaker arrangement according to the invention, for example as shown in FIG. 10, insofar as the signal for one ear is supplied to one transducer 42 and the signal for the other ear is supplied to the transducer 43, with the polarity arrangement as described with reference to FIG. 10. If for example the loudspeaker arrangement is suspended from the ceiling in the middle of the room, with the axis of rotation 41 parallel to the ceiling, the recordings made with the artificial head are reproduced in the room. The hearer can then position himself at the location of the dummy head, approximately at the location of the microphone 53 shown in FIG. 11, noting where front and rear are located. It wil be appreciated that the establishment of the directions 'front' and 'rear' may be anticipated by the transducers 42 and 43 being set in a slightly inclined angular positon in the manner shown in FIG. 17, by arranging the transducers similar to external ears, or by mounting suitable shielding means over the centre of the transducer. Although many constructions are possible with this dummy head reproduction which requires only one housing, it will be appreciated that, in view of the technique of transmission time and intensity stereophone which is currently used nowadays, it seems more advantageous at the present time for a respective loudspeaker arrangement (for example as shown in FIG. 10) to be provided for each ear signal and for the two or more transducers of each loudspeaker arrangement to be connected with the same phase.

Finally, the invention is not limited to the housing forms described above with reference to FIGS. 6, 8, 10, 11, 13, 14 and 17. For example, housings are also suitable in which the cross-sections approximately correspond throughout to the cross-sections of the housing shown in FIG. 10 and are therefore for example hexagonal, while the upper and lower ends of these housings are each covered by a respective flat wall whose plan view configuration corresponds to the cross-sectional form shown in FIG. 10 and is therefore for example also hexagonal. Hybrid forms between the above-described housing configurations are also possible.

I claim:

1. A loudspeaker comprising: a substantially closed housing having an discus-like configuration and having a front wall and a rear wall each having an inner portion and an outer portion with an outer edge, said walls being formed and arranged such that the distance between decrease in a direction from said inner to the outer portions such that the outer edges thereof abut along at least two side edges; and at least two similar electro-acoustic transducers, each having a diaphragm, wherein one transducer is arranged in the front wall and the other transducer is arranged in the rear wall and wherein the two transducers are so connected that when connected to a common source said diaphragms are moved simultaneously outwardly or inwardly, respectively.

2. A loudspeaker according to claim 1, wherein the housing is secured in a mounting which can be stood or hung up.

3. A loudspeaker according to claim 1, wherein the transducers have a viscoelastic diaphragm which is deflected by a moving coil.

4. A loudspeaker according to claim 1, wherein at least one portion of a group of a convex and concave curved portions is formed in the front wall.

5. A loudspeaker according to claim 1, wherein the two housing walls are fixedly supported relative to each other.

6. A loudspeaker according to claim 1, wherein the two transducers are arranged substantially coaxially in the front and rear wall respectively.

7. A loudspeaker according to claim 1, wherein said walls consist of half-shells having identical size and configuration.

8. A loudspeaker according to claim 1, wherein the transducers are so arranged in the housing that their diaphragms terminate substantially flush with the outer surfaces of said walls and, in the non-excited condition, represent a very uniform continuation of said surfaces.

9. A loudspeaker according to claim 1, wherein the front wall and the rear wall each substantially comprise a conical surface each having an outer closed peripheral abutment line along which the outer edges of said walls contact each other.

10. A loudspeaker according to claim 9, wherein the diameter of said abutment line is about 70 cm.

11. A loudspeaker according to claim 1, wherein the front wall and the rear wall each substantially comprise a portion of a sphere each having an outer closed peripheral abutment line along which the outer edges of said walls contact each other, and wherein the radius of curvature of said sphere portions is greater than the radius of said abutment line.

12. A loudspeaker according to claim 11, wherein the diameter of said abutment line is about 70 cm.

13. A loudspeaker according to claim 1, wherein a respective plurality of electro-acoustic transducers is arranged in each of the front wall and the rear wall of the housing.

14. A loudspeaker according to claim 13, wherein each plurality of transducers is arranged on a respective straight line and the transducers in the rear wall are mounted symmetrically with respect to the transducers in the front wall.

15. A loudspeaker according to claim 1, wherein the housing has a rotational axis and is rotationally symmetrical with respect to said axis, and the two transducers are arranged substantially coaxially with said rotational axis.

16. A loudspeaker according to claim 15, wherein said distance between said diaphragms or said inner portions of said walls, respectively, is smaller than the distance between said rotational axis and said outer edge.

17. A loudspeaker according to claim 1, wherein the two transducers are flexibly supported relative to each other.

18. A loudspeaker according to claim 17, wherein each transducer is mounted in a ring and the two rings are connected together by a strut arrangement.

19. A loudspeaker according to claim 18, wherein the transducers are mounted so as to be damped and isolated in the rings or in the housing walls.

* * * * *